US006048044A

United States Patent [19]

Biggel et al.

[11] Patent Number: 6,048,044

[45] Date of Patent: Apr. 11, 2000

[54] COLLAPSIBLE WORKSTATION

[75] Inventors: Franz Biggel, Wangen; Burkhard Schmitz, Ulm, both of Germany

[73] Assignee: Herman Miller Inc., Zeeland, Mich.

[21] Appl. No.: 09/015,439

[22] Filed: Jan. 29, 1998

Related U.S. Application Data

[60] Provisional application No. 60/035,542, Jan. 29, 1997.

[30] Foreign Application Priority Data

| | | | |
|---|---|---|---|
| Jul. 29, 1994 | [DE] | Germany | 44 26 921 |
| Apr. 10, 1995 | [DE] | Germany | 195 12 712 |
| Jul. 22, 1995 | [WO] | WIPO | PCT/DE95/00968 |

[51] Int. Cl.[7] ..... A47B 43/00

[52] U.S. Cl. ..... 312/258; 312/223.3; 312/314; 312/249.8

[58] Field of Search ..... 312/249.8, 258, 312/194, 196, 198, 199, 249.13, 140.2, 201, 203

[56] References Cited

U.S. PATENT DOCUMENTS

| | | | |
|---|---|---|---|
| 258,604 | 5/1882 | Richardson . | |
| 786,670 | 4/1905 | Parker . | |
| 1,027,816 | 5/1912 | Cassity . | |
| 1,128,031 | 2/1915 | Needleman . | |
| 1,133,866 | 3/1915 | Leighty . | |
| 1,348,073 | 7/1920 | Almy . | |
| 1,943,282 | 1/1934 | Bellavia . | |
| 2,014,745 | 9/1935 | Regli | 211/90.01 |
| 2,870,459 | 1/1959 | Zabielski | 312/201 |
| 3,140,133 | 7/1964 | Kraft | 312/140.2 |
| 4,478,467 | 10/1984 | Tyndall . | |
| 4,637,177 | 1/1987 | Long . | |
| 5,072,999 | 12/1991 | Trotta et al. | 312/249 |
| 5,429,432 | 7/1995 | Johnson . | |
| 5,536,080 | 7/1996 | Madimenos et al. . | |
| 5,558,418 | 9/1996 | Lambright et al. . | |

FOREIGN PATENT DOCUMENTS

| | | | |
|---|---|---|---|
| 446064 | 8/1945 | Canada | 312/258 |
| 1218476 | 5/1980 | France | 312/203 |
| 91 16 058 | 12/1991 | Germany . | |
| 94 04 456 | 3/1994 | Germany . | |

*Primary Examiner*—Peter M. Cuomo
*Assistant Examiner*—Jerry A. Anderson
*Attorney, Agent, or Firm*—Brinks Hofer Gilson & Lione

[57] ABSTRACT

A collapsible workstation, a collapsible service unit, a system of workstations, and a system and method for providing work environments is disclosed. The workstation has a first and second side wall and a third side wall hingedly attached to the first and second wall. A first worksurface is attached to one of the walls. A second worksurface moves between a vertical and a horizontal orientation, extending beyond the space within the side walls. A transportable and collapsible service unit comprises at least one device shared by a plurality of workstation users. A system of workstations comprises workstations and a service unit having a device shared by a plurality of the workstation users. A system and method for providing work environments at remote locations includes maintaining an inventory of workstations adapted to be arranged with other workstations to define a work environment. An order specifies a remote location and the workstations requested. A transporting means transports the workstations.

2 Claims, 13 Drawing Sheets

COLLAPSIBLE WORKSTATION

This application claims benefit of provisional application Ser. No. 60/035,542 filed Jan. 29, 1997.

BACKGROUND OF THE INVENTION

The present invention relates generally to a workstation. More specifically, the invention relates to a collapsible workstation.

There is an increasing need for work environments which can be configured and reconfigured, particularly for the temporary user and temporary work groups. Consequently, there is an increasing need for workstations which make up a temporary work environment.

For example, temporary employees or contractors are increasingly called upon to perform functions either at an employer's normal place of business or at a remote location. These functions may involve secretarial, accounting, auditing, or financial assistance during certain times of the year. In another situation, a team of employees may be required to work off-site at, for example, a supplier's manufacturing facility or a remote manufacturing, engineering or design facility. In still other situations, a project team from a related business or subsidiary may be temporarily required to work with another engineering or marketing project team.

The rise in the number of employees spending an amount of time away from a permanent office setting is another trend increasing the need for temporary workstations. For example, sales and marketing personnel who spend a large portion of their time on the road may not require a permanent office or workstation. Therefore, there is an increasing need for a temporary workstation for an employee making temporary or short term office visits.

Work at home professionals telecommuting between their home and office is another general trend driving the need for a temporary workstation. Typically, the telecommuter communicates with the office via the telephone, facsimile, electronic mail or pager. As the number of telecommuting employees increases, it would be desirable to support telecommuters with a home workstation which is generally uniform in its features and communications capabilities.

One solution for providing a workstation for these and other types of temporary users is to redesign an existing workplace. Sometimes, the existing workplace has vacant space available while at other times, the existing workplace is at full capacity. In either situation, the workplace is usually reconfigured by providing additional worksurfaces, utilities, structures, walls, etc. to create the temporary workstations. Consequently, the installation and/or reconfiguration often requires costly redesign and may interrupt the existing work environment and/or work flow.

Further problems may arise where the proposed temporary work environment has inadequate facilities. For example, if a user wishes to set up a temporary workplace in her home, at the home office or in a hotel room, utilities such as a phone system, extra data lines, copiers, computers, video monitors, printers, etc. may not be accessible. In other situations, for example, where the temporary workstation user will be located on a manufacturing floor, installing the appropriate utilities may not be cost effective.

SUMMARY OF THE INVENTION

Briefly stated, the invention is directed to a collapsible workstation, a system for providing a work environment for multiple users and a system and method for providing work environments at multiple and varying remote locations.

The collapsible workstation has a first side wall and a second side wall. A third side wall is hingedly attached to the first side wall and the second side wall. A first worksurface is attached to the first side wall. A second worksurface is adapted to move between a generally vertical orientation when the workstation is collapsed to a generally horizontal orientation adjacent the first worksurface and extending beyond the space within the side walls when the workstation is expanded.

In another aspect of the invention, a transportable and collapsible service unit comprises at least one device shared by a plurality of workstation users.

In another aspect of the invention, a system provides a work environment for multiple users. The system comprises a plurality of transportable and collapsible workstations and at least one transportable service unit having at least one device shared by the users of the plurality of the workstations.

In another aspect of the invention, a system for providing work environments at multiple and varying remote locations comprises an inventory of workstations maintained at a first location. The workstations are adapted to be arranged with other of the workstations to thereby define a work environment. The workstations are collapsible and transportable. A receiving means receives an order specifying the remote location and the number and type of workstations requested. A transporting means transports the workstations.

In still another aspect of the invention, a method for providing work environments at multiple and varying remote locations comprises the steps of maintaining an inventory of workstations at a first location, receiving an order specifying the remote location, and transporting the requested number of workstations to the requested remote location.

By the term "workstation" it is meant to refer to a work area having tools, devices or utilities for supporting the work tasks of a user. These tasks may include working at a computer, sending and receiving e-mail, writing correspondence, sending facsimiles, accessing the internet, an intranet, a LAN or WAN, teleconferencing, printing documents, and other generally known tasks. The work area may include one or more worksurfaces, shelves, storage units, cabinets, marker boards, white boards and the like.

By the term "collapsible workstation," it is meant to refer to workstations which can be collapsed or folded. The workstation can be partially or entirely opened, unfolded or expanded so that the tools, devices, and utilities of the workstation are available for use. The workstation can be closed or collapsed forming a generally multi-walled enclosure. By the term "transportable workstation," it is meant to refer to a workstation which can be shipped, preferably by common carrier, or wheeled from one location to the next.

By the term "service unit," it is meant to refer to a servicing or support unit which provides some type of hardware or device shared by a plurality of workstations. The service unit may be used to network the plurality of workstations in a work environment. The term "signals" is meant in its broadest of terms and includes hard wire signals as well as infrared or other like type signals generally known in the art as wireless signals.

The collapsible workstation of the preferred embodiment provides a number of benefits. For example, in certain types of temporary employee situations, an existing permanent work environment need not be reconfigured. A collapsible workstation can be deployed when the need for temporary users arises. The workstation can collapse into an enclosure for storage, security and transportation.

Moreover, such workstations may be maintained in an inventory which allows the workstation to be customized to a user's specifications. These workstations can define a complete work environment. Workstations can be delivered to a user and, after use, returned for updating, cleaning, repairing or refurbishing. An employer can therefore provide a standard, uniform workstation to its temporary employees, off-site employees and/or telecommuters. Standard, uniform workstation units could increase the quality of the communications and perhaps the employee work product. Rather than reconfigure an existing work environment, service units could provide a device or utility shared by the workstations making up a work environment.

The present invention, together with further objects and advantages will be best understood by reference to the following detailed description taken in conjunction with the accompanying drawings.

DETAILED DESCRIPTION OF THE PREFERRED EMBODIMENTS

Figure 1:
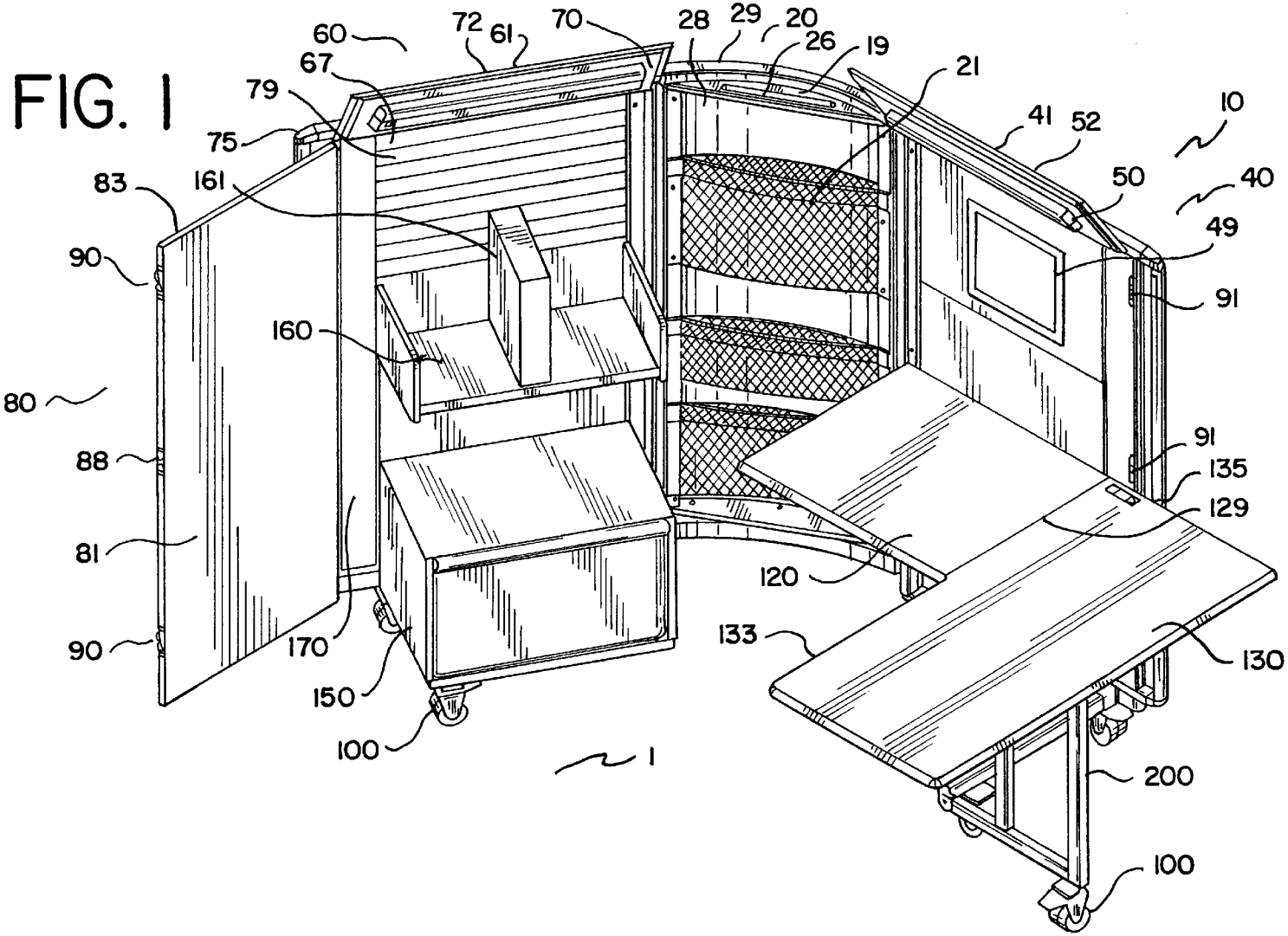
FIG. 1 is a perspective view of a preferred embodiment of the present invention in an expanded state.

Referring to the drawings, FIG. 1 shows a perspective view of the preferred embodiment of a collapsible workstation 10 in an unfolded or expanded state. Workstation 10 resides on existing floor 1 and comprises four side walls 40, 20, 60, and 80 which define the general boundaries of an interior work space available within the workstation 10. Within this work space, a first worksurface 120 is attached to the first side wall 40. A second worksurface 130 is also provided.

With the workstation expanded as shown in FIG. 1, the second worksurface 130 is in a generally horizontal orientation extending beyond the space within the side walls. The second worksurface 130 is movable between the generally horizontal orientation and a generally vertical orientation. (See FIG. 5)

The workstation shown in FIG. 1 is collapsible into a generally rectangular shape. The workstation 10 will be initially described in a collapsed or folded state and then described in an unfolded or expanded state.

Figure 2:
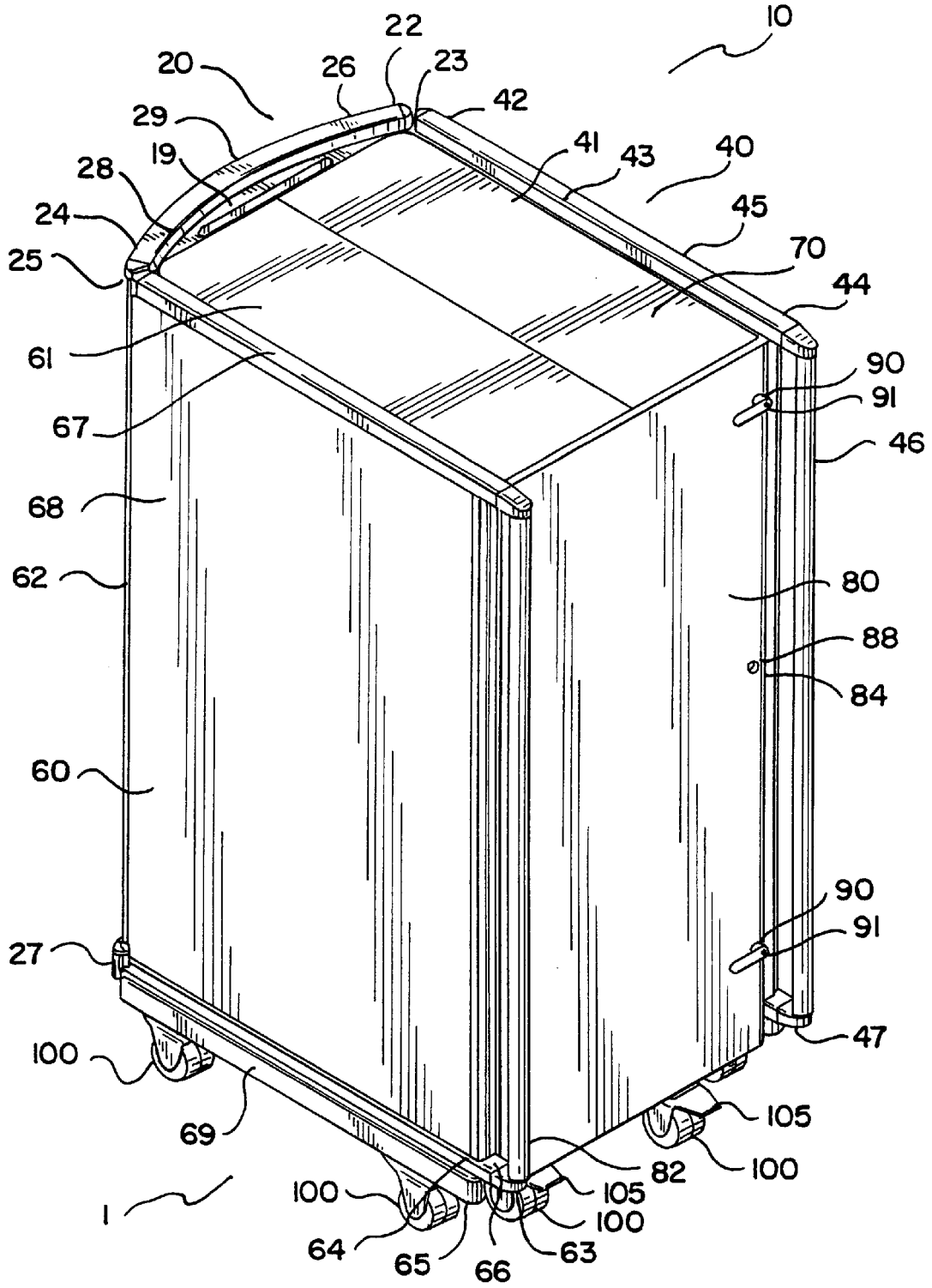
FIG. 2 is a perspective view of the preferred embodiment shown in FIG. 1 in a collapsed state.
Figure 3:
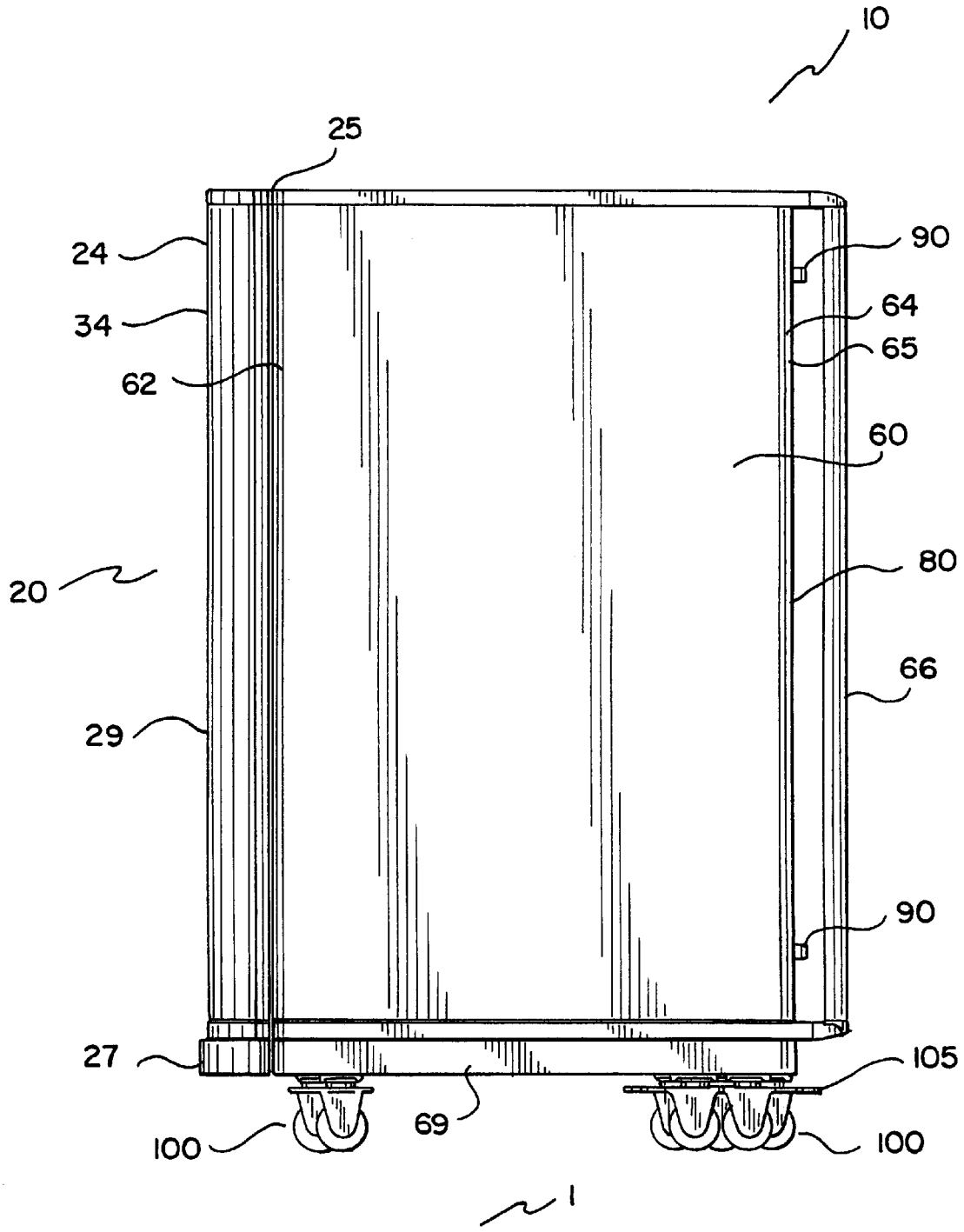
FIG. 3 is a side view of the preferred embodiment shown in FIG. 2.
Figure 4:
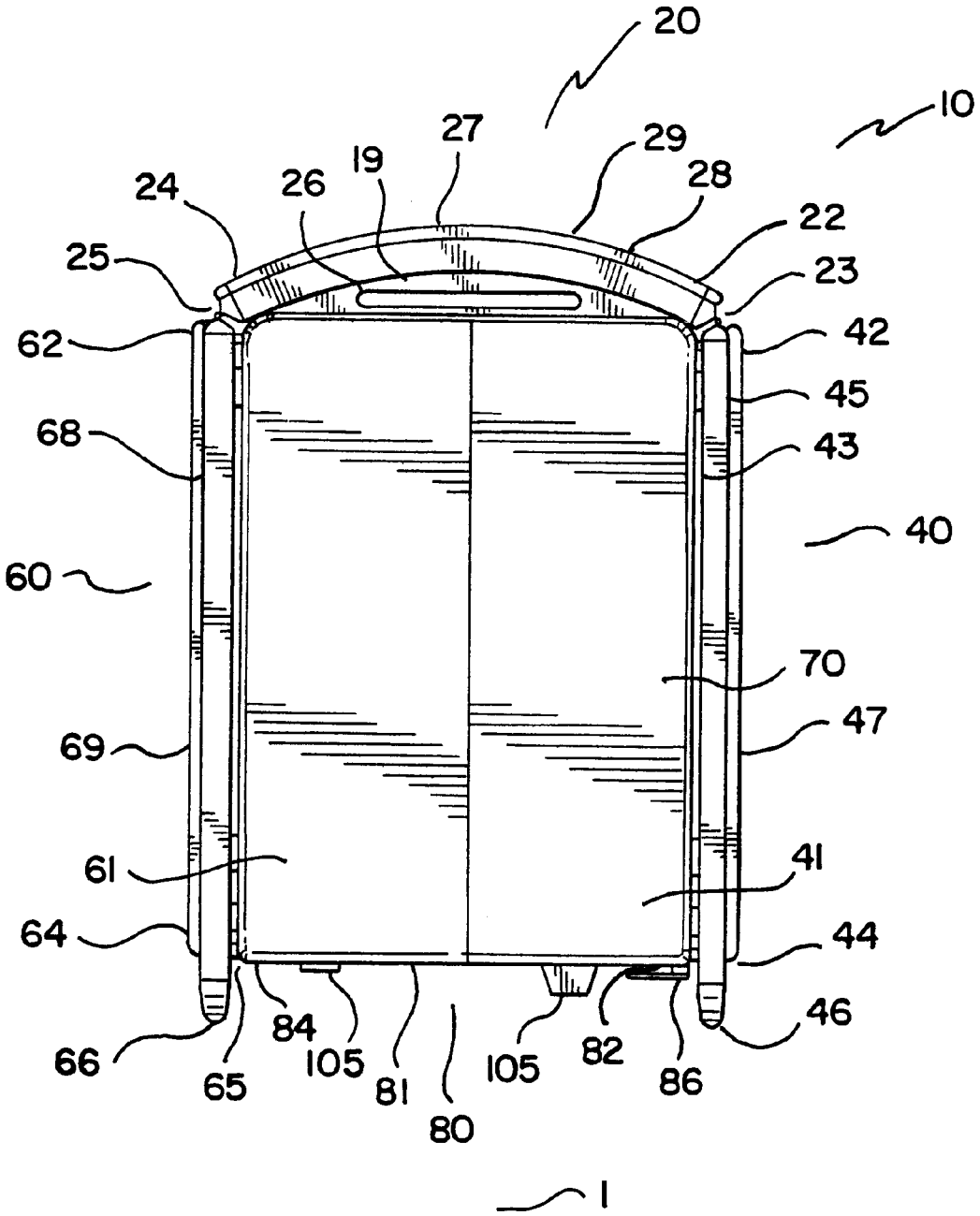
FIG. 4 is a top view of the preferred embodiment shown in FIGS. 2–3.

FIG. 2 is a perspective view of the preferred embodiment of workstation 10 shown in FIG. 1 in a collapsed state. FIG. 3 is a side view of the collapsible workstation 10 shown in FIG. 2. FIG. 4 is a top view of the collapsible workstation shown in FIGS. 2–3. By collapsing or folding the workstation, transporting the workstation is simplified.

Referring to FIGS. 2–4, workstation 10 has a first side wall 40, a second side wall 60, a third side wall 20, and a fourth side wall 80. First side wall 40 comprises a first vertical edge 44, a second vertical edge 42, a top cover 41, an inner surface 43 and an outer surface 45. Preferably, a hand rail 46 and latch receiving devices 91 are provided along the first vertical edge 44.

Hand rail 46 is a cylindrical member which is preferably rigidly affixed to a bottom and a top of the first side wall 40. Hand rail 46 facilitates maneuvering workstation 10 while it is either collapsed into the state shown in FIG. 2 or expanded into the state shown in FIG. 1.

A latch receiving device 91 is provided at a top and a bottom portion of the side wall 40. Preferably, the latch receiving device is attached adjacent the first vertical edge 44 of side wall 40. As will be further discussed with reference to FIG. 5, latch receiving device 91 provides a means for latching the fourth side wall 80 to the first side wall 40 while the workstation 10 is in the collapsed state.

Top cover 41 is disposed along the top of the first side wall 40 and is preferably hingedly attached to the inner surface 43 of side wall 40 so that it can be swung up vertically or assume an intermediate, sloping position.

The first side wall 40 further comprises a bumper 47 which preferably is located at the bottom of the side wall 40. Bumper 47 reduces the amount of damage caused to the outer surface 45 of the side wall 40 during transportation. Preferably, the bumper 47 is made from a soft yet impact resistant material like rubber.

Third side wall 20 has a first vertical edge 22, a second vertical edge 24, an outer surface 29 and an inner surface 28. Preferably, the second vertical edge 42 of first side wall 40 is hingedly attached to the first vertical edge 22 of the third side wall 20.

The third side wall 20 has a generally convex shape. The convex shape increases the overall surface area of the inner surface 28 of the third side wall 20. The interior work space available within the workstation 10 is therefore also increased. This shape also serves an aesthetic function in that the collapsed four-walled enclosure as shown in FIGS. 2–4 appears generally smaller than it actually is since the length of side walls 40, 60 do not have to be increased in order to achieve the resulting increase in overall interior work space.

Preferably, the third side wall 20 comprises a top cover 19 which is partially overlapped by the top cover 41 of first side wall 40. More preferably, top cover 19 has a mail slot 26 which allows mail, correspondence and the like to be deposited in a collapsed or expanded workstation. Mail slot 26 also acts as an air vent allowing air to be circulated within a collapsed workstation. By circulating air through a collapsed workstation, powered equipment, tools or utilities which have been inadvertently left on may be prevented from overheating.

Preferably, third side wall 20 further comprises a bumper 27 disposed along the bottom of the side wall 20. Bumper 27 has generally the same mechanical characteristics and advantages as bumper 47 of first side wall 40.

Second side wall 60 has a first vertical edge 64, a second vertical edge 62, a top cover 61, an inner surface 67 and an outer surface 68. Vertical edge 24 of third side wall 20 is attached to vertical edge 62 of the third side wall 60 preferably via a hinge 25. More preferably, vertical edge 42 of the first side wall 40 and vertical edge 62 of the second side wall 60 are attached to the second side wall 20 in a similar manner.

First vertical edge 64 of second side wall 60 includes a hand rail 66. Hand rail 66 generally facilitates the maneuverability of collapsible workstation 10 and has the same height as second side wall 60. More preferably, hand rail 66 has similar mechanical characteristics as the hand rail 46 attached to first side wall 40.

Preferably, a bumper 69 is disposed along the bottom of the side wall 60. Bumper 69 has the same mechanical characteristics and advantages as the bumper 47 of first side wall 40.

Fourth side wall 80 comprises a first vertical edge 82 and a second vertical edge 84 and has the same general width as the third side wall 20. First vertical edge 82 of fourth side wall 80 is attached to the first vertical edge 64 of second side wall 60. Preferably, the fourth side wall 80 is hingedly attached to the second side wall 60 via hinge 65. More preferably, hinges 23, 25 and 65 have generally similar mechanical characteristics.

Fourth side wall 80 has a width generally equivalent to a width of the third side wall 20 and preferably has a lock 88 and latching devices 90. Preferably, lock 88 is a key latch which releasably locks the second vertical edge 84 of side wall 80 to the first side wall 40. The workstation 10 can therefore be collapsed and then locked in the collapsed state, preferably a generally rectangular box. Alternatively, lock 88 has a handle 86 (shown in FIG. 4) which facilitates manually locking and unlocking the collapsed four-walled enclosure.

Fourth side wall 80 has at least two latching devices 90 disposed along the second vertical edge 84. Preferably, the latching devices are cam lever activated wherein the cams are manipulated via a lever. With the lever in the horizontal position as shown in FIG. 2, the latching device cam engages a latch of receiving device 91 (shown in FIGS. 1 & 6) of the first side wall 40. The second vertical edge 84 of side wall 80 is thereby secured to the first side wall 40. Latching devices 90 allow workstation 10 to be releasably secured in the collapsed state. With the lever positioned in the vertical position, the latching device cam disengages the latch of the receiving device 91.

By preferably hingedly attaching the first and second side walls 40, 60 to the third side wall 20, the side walls 40, 60 swing away from the third side wall 20. Similarly, by preferably hingedly attaching second side wall 60 to the fourth side wall 80, side wall 80 can swing away from the second side wall 60. In this manner, the generally rectangular collapsed workstation shown in FIGS. 2–4 can be unfolded or expanded into a four walled workstation. Alternatively, the collapsible workstation has only two side walls.

The four walled enclosure is a generally rectangular box wherein the height of the four side walls 20, 40, 60 and 80 are generally equal. Preferably, the top covers of the first, and second side walls, 41 and 61, meet one another and partially overlap third side wall 19 as the workstation is collapsed. These top portions reside in a same plane, thereby defining a top wall 70. In this manner, the generally rectangular box formed by the collapsed workstation can be entirely closed along the top wall 70. The preferred enclosure generally facilitates storing, packing and inventorying the workstations.

Because the preferred embodiment is transportable in any collapsed or expanded state, the collapsible workstation walls 40, 20, 60 and 80 is preferably made of a material which is generally lightweight. The material should also be durable enough to withstand impacts which may occur while transporting the workstation. An example of a side wall 40, 60 material that may be used in a preferred embodiment includes a composite compressed fiberglass from SoundTech, Inc. An example of a side wall 20 material that may be used in a preferred embodiment includes a plywood layup from Holland Stitchcraft, Inc.

The outer surfaces of side walls 40, 60 and 20 may be made from a rugged material such nylon, vinyl or vinyl-like derivative. An example of a material that may be used in a preferred embodiment includes cordura nylon from SoundTech, Inc.

Alternatively, side wall 40, 60 outer surfaces are made from a tackable fabric such as compressed fiber board. An example of a fiber board that may be used in a preferred embodiment includes a composite compressed fiberglass from SoundTech, Inc. In this alternative embodiment, accessories such as marker boards, white boards, tack boards or the like are provided along the outer surfaces of the side walls.

A protective cover can be provided which slips over the outer surfaces of the collapsed workstation, thereby providing the workstation with increased impact protection during transportation or storage. The cover may be made from a single piece or material or alternatively multiple pieces. The cover is sized to tightly envelope the collapsed workstation. Alternatively, the cover could be configured so that it is secured to the workstation via snaps, zippers, buttons, Velcro or the like. The cover also prevents dust and other like contaminants from entering the work area of the workstation.

Returning to FIGS. 2–4, the collapsible workstation 10 further comprises casters 100 secured at various underside locations of workstation 10. Casters 100 enable the collapsible workstation 10 to be wheeled about while in the collapsed or expanded state. Casters 100 also enable the workstation to be collapsed or unfolded. Preferably, casters 100 are provided with a locking device 105 which can be engaged to prevent unwanted moving of the workstation 10. More preferably, at least one locking device is engageable while the workstation 10 is in the collapsed state.

Figure 5:
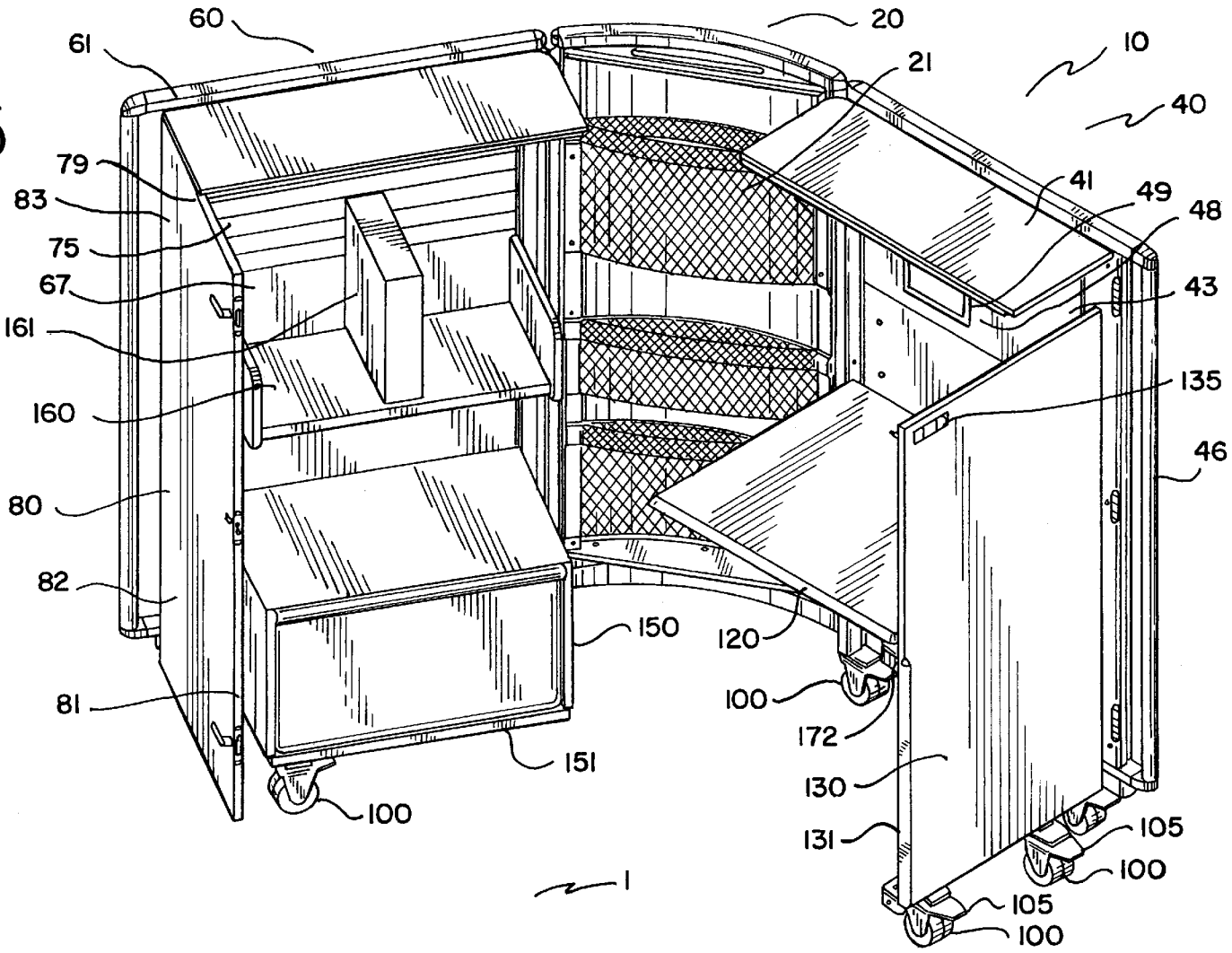
FIG. 5 is a perspective view of the preferred embodiment of the present invention in a partially expanded state.
Figure 6:
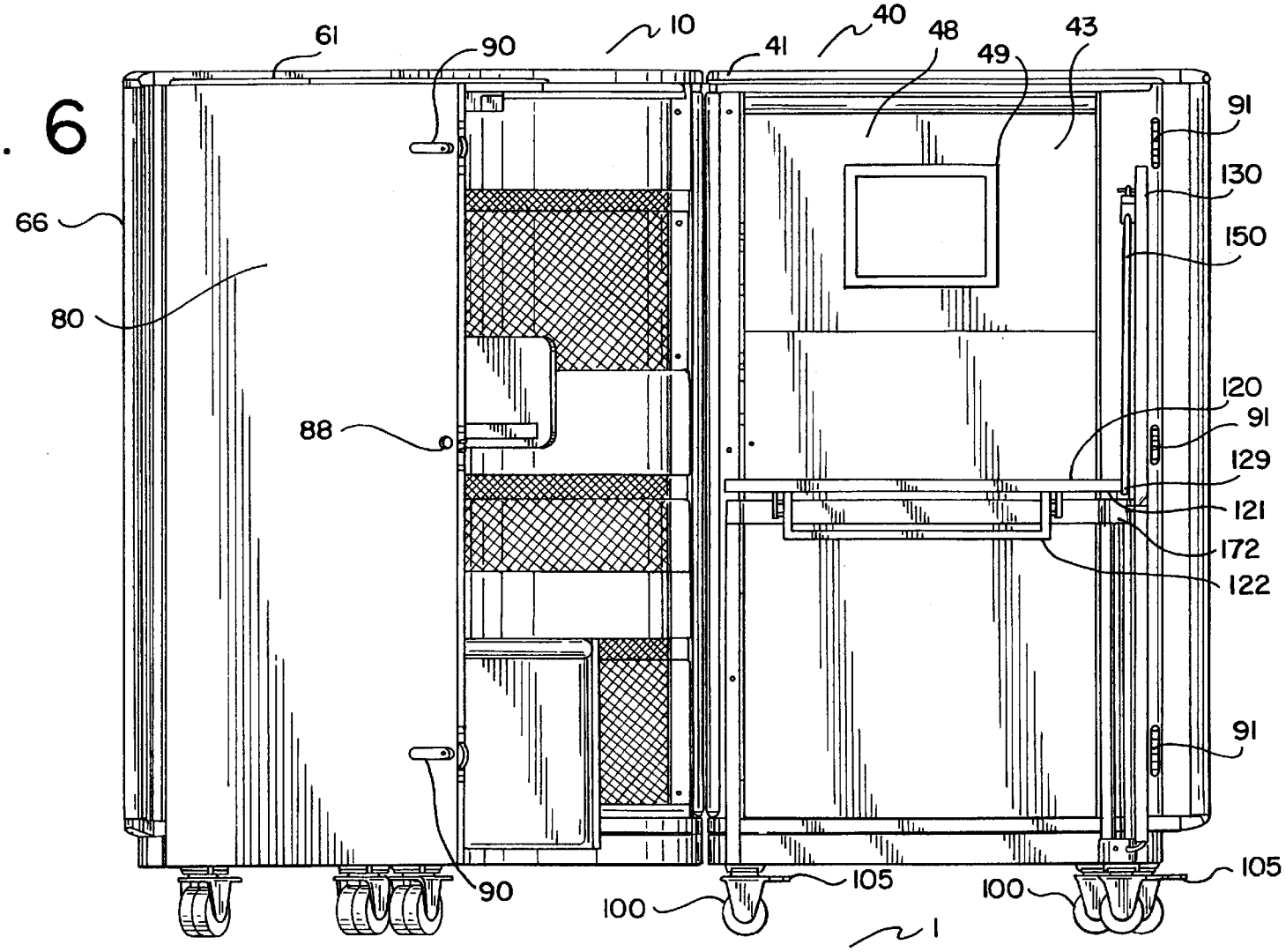
FIG. 6 is a side view of the preferred embodiment shown in FIG. 5.
Figure 7:
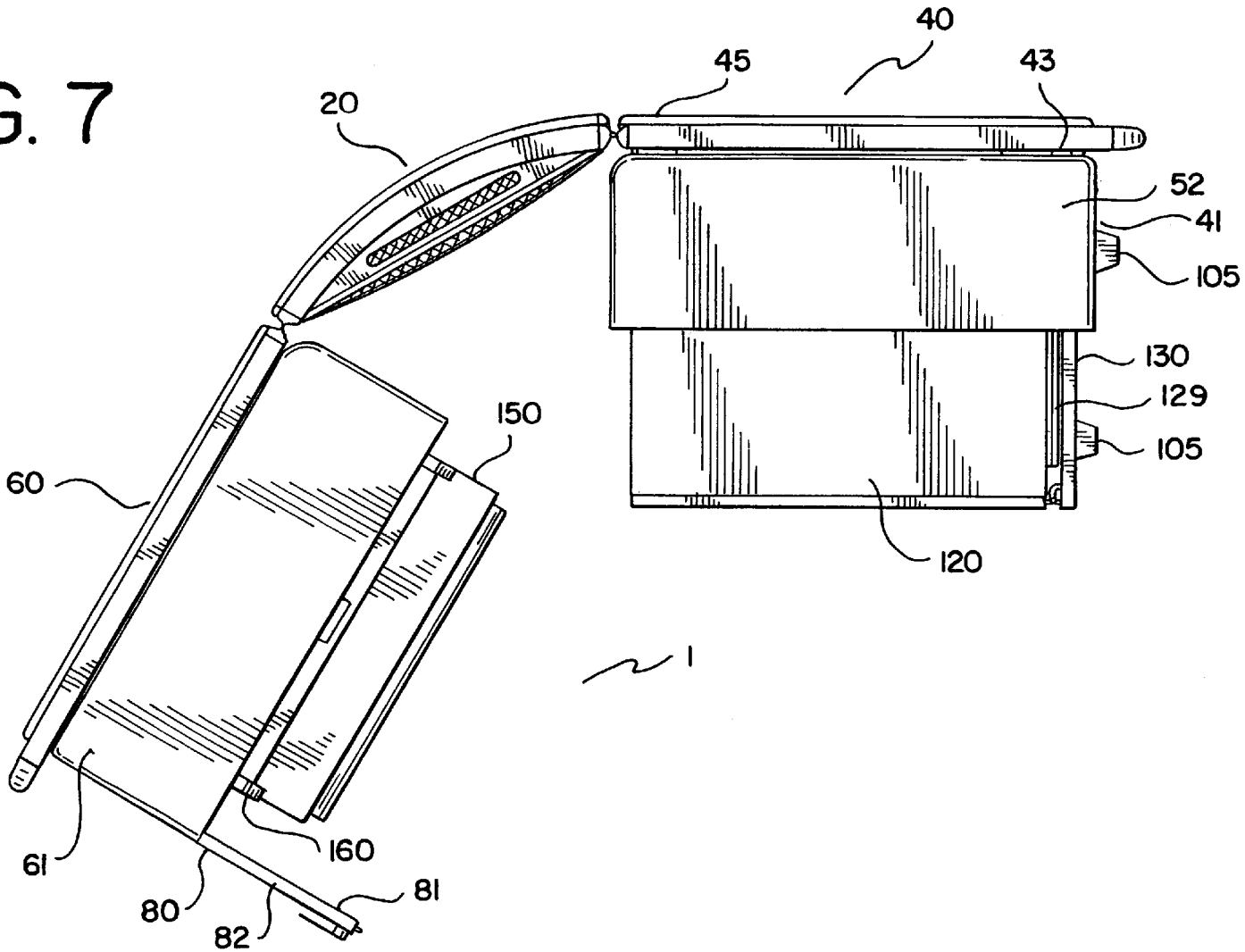
FIG. 7 is a top view of the preferred embodiment shown in FIGS. 5–6.

FIG. 5 is a perspective view of workstation 10 with the first side wall 40 and third side wall 20 in an expanded position. FIG. 6 is a side view of the workstation 10 shown in FIG. 5. FIG. 7 is a top view of the workstation 10 shown in FIGS. 5 and 6.

As seen in FIG. 5, the inner surface 43 of first side wall 40 preferably comprises a vertical surface area 48, a first worksurface 120, a second worksurface 130 and a top cover 41.

The workstation and preferably the inner surfaces of the side walls can be customized by selectively including removable components. For example, various removable components could be attached, mounted on or installed on surface area 48. Such components could include a telephone, a computer, answering machine, video monitor, speakers, light units, storage devices, a tack board, white board or marker board. A workstation can therefore be customized for a particular use.

Preferably, a video monitor 49 is provided on surface area 48. Alternatively, a holding device for storing paper pads, marker boards or other accessories ordinarily used in the workstation is provided.

Worksurface 120 is provided along inner surface 43 below surface area 48. Worksurface 120 has a length generally equivalent to the length of first side wall 40. Alternatively, a worksurface having a shorter length may be provided. Worksurface 120 has a preferred width generally equivalent to the width of the third side wall 20.

In the preferred embodiment, worksurface 120 is rigidly attached to the inner surface 43. Worksurface 120 resides in a horizontal plane at a height above the existing floor 1 so that a user of the workstation 10 can sit comfortably adjacent the worksurface 120. The worksurface 120 comprises a work member 122 disposed on an underside 121 of the worksurface 120. Work member 122 can be a pencil drawer or a computer keyboard tray.

Preferably, worksurface 120 remains in a horizontal orientation whether the workstation 10 is in the collapsed or expanded state. The worksurface 120 resides at a height different than other workstation components residing on inner surface 67 of the second side wall 60. At this preferred height, as the workstation 10 is collapsed into the state shown in FIGS. 2–4, worksurface 120 moves freely and does not collide with other components of the workstation 10.

When the workstation is expanded, second worksurface 130 is attached to workstation 10 and has a preferred width generally equivalent to the width of the third side wall 20. In the vertical orientation, the second worksurface 130 has a preferred height generally equivalent to the height of the workstation 10.

As shown in FIGS. 5–7, second worksurface 130 is in a vertical orientation, generally perpendicular to worksurface 120. While second worksurface 130 remains in this vertical orientation, workstation 10 can be collapsed into the generally rectangular shape shown in FIGS. 2–4. In the collapsed position, the second worksurface resides adjacent the fourth side wall 80 and underneath top cover 61 of the second side wall 60. Second worksurface 130 is adapted to move between the generally vertical orientation shown in FIGS. 5–7 and the horizontal orientation shown in FIG. 1.

FIGS. 5–7 also show the third side wall 20 and second side wall 60 in an unfolded state. As previously mentioned, third side wall 20 has an inner surface 28 and a top cover 19. Preferably, inner surface 28 comprises a retaining device 21. Retaining device 21 could be a sack, pouch, netted or mesh-like bag which cooperates with mail slot 26 of top cover 19 so that it can catch or retain mail, correspondence or the like deposited through mail slot 26. Retaining device 21 can also be used to hold an inventory of workstation spare parts, accessories or office supplies including items such as pens, paper, marker boards or the like.

Inner surface 67 of second side wall 60 is shown in FIG. 5. Preferably, inner surface 67 includes a vertical surface area 75, top cover 61, a shelf 160 and a storage cabinet 150. Various workstation accessories can be attached, mounted or installed on surface 75. Alternatively, a holding device for storing paper pads, marker boards or other accessories ordinarily used in the workstation is provided.

Figure 8:
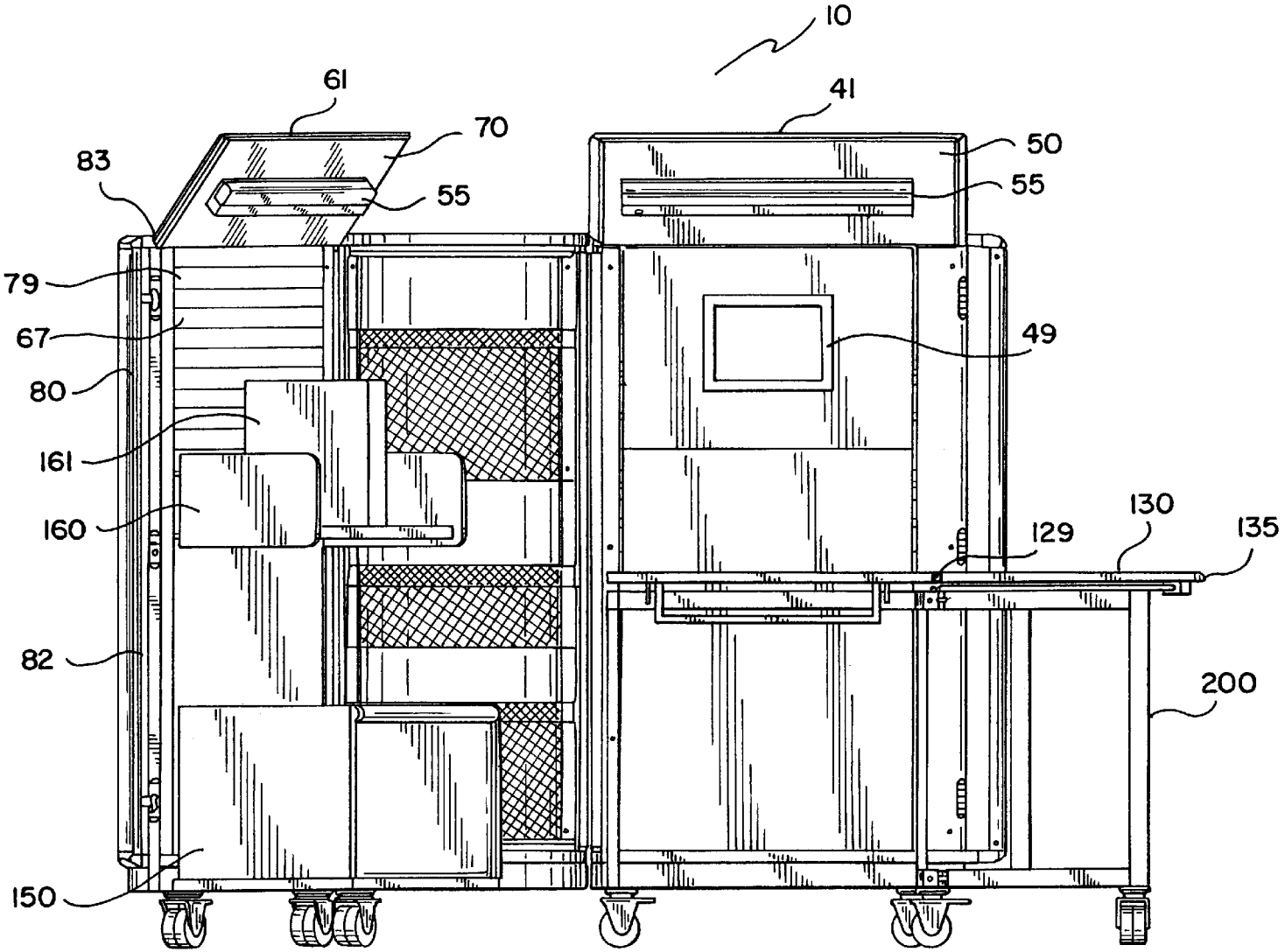
FIG. 8 is a side view of the preferred embodiment shown in FIG. 1.

Preferably, the surface 75 includes a retaining device 79, as shown in FIGS. 1 and 8. The retaining device 79 provides a means for mounting work-in-process items such as trays, tape dispensers, small tiles, and the like. For a complete description and disclosure of that device, one is directed to U.S. Pat. No. 4,876,835, issued to Kelly et al. on Oct. 31, 1989, the entire disclosure of which is hereby incorporated by reference.

Shelf 160 is rigidly attached in a horizontal orientation along the inner surface 67 of the second side wall 60. Shelf 160 may support texts 161 or alternatively utilities such as printers, copiers or other types of office machines ordinarily used in a work environment.

Shelf 160 has a length generally equivalent to a length of the second side wall 60 and a width generally equivalent to the width of the third side wall 20. In this preferred embodiment, as the workstation 10 is collapsed, shelf 160 remains in a horizontal plane above the horizontal plane defined by worksurface 120. Therefore, shelf 160 collapses freely above worksurface 120 and does not collide with other workstation components.

Storage cabinet 150 is preferably attached to inner surface 67 of side wall 60 below shelf 160. Storage cabinet 150 is used for storing files or the like and preferably comprises a pull-out drawer. Alternatively, a platform is provided for storing devices such as computers, copying machines, printers or the like. Casters 100 are attached to the underside 151 of the storage cabinet 150 and allow the workstation 10 to be wheeled about.

Figure 9:
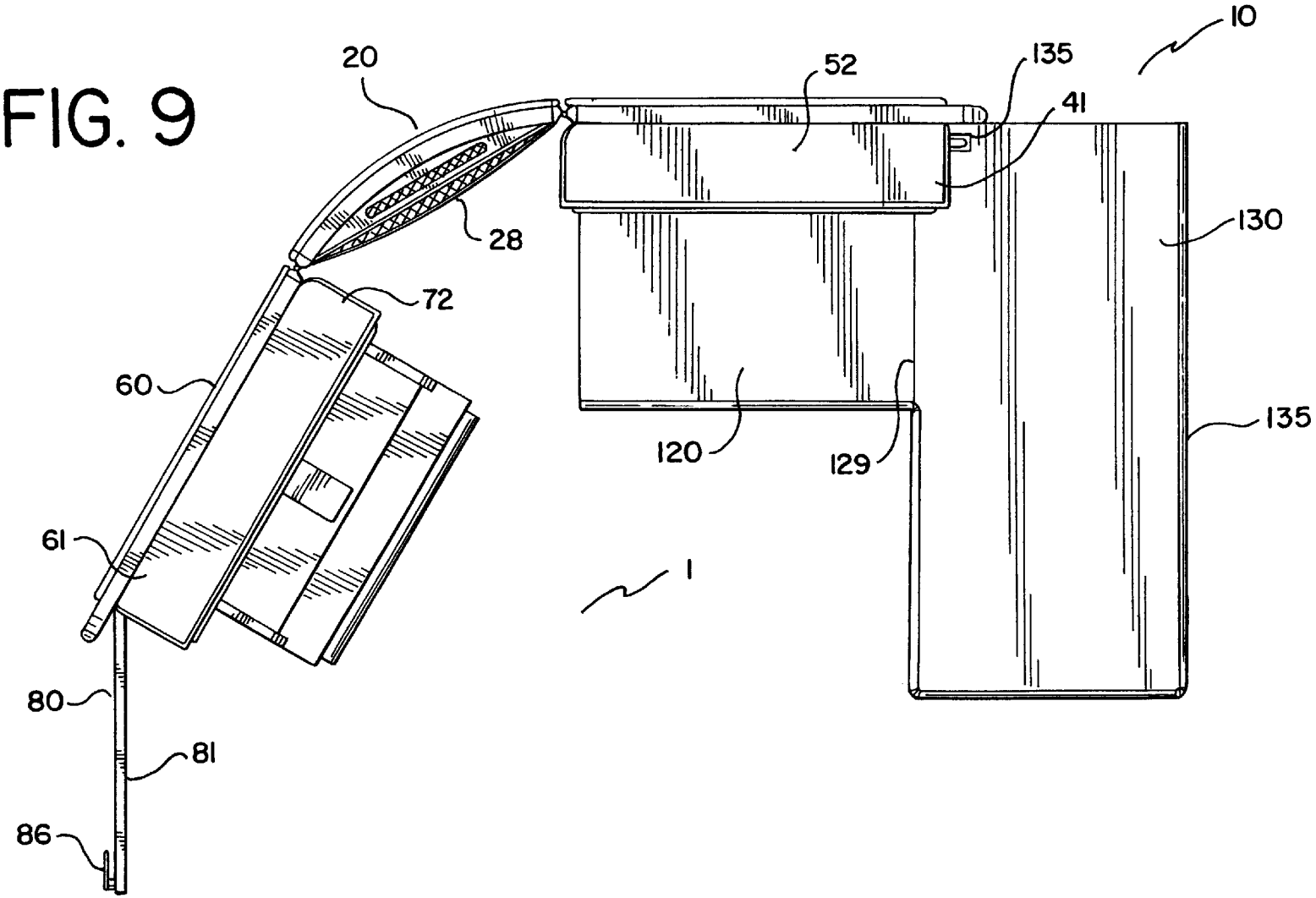
FIG. 9 is a top view of the preferred embodiment shown in FIG. 8.

As mentioned previously, FIG. 1 is a perspective view of the collapsible workstation 10 in an unfolded or expanded state with the interior work space exposed. FIG. 8 is a side view of the preferred embodiment shown in FIG. 1. FIG. 9 is a top view of the preferred embodiment shown in FIGS. 1 and 8. In this unfolded or expanded state, the inner surfaces of all the side walls are shown, the second worksurface 130 resides in an horizontal orientation, and the top covers 41, 61 are swung open.

FIGS. 1, 8 and 9 show second worksurface 130 in a horizontal orientation, extending beyond the interior work space defined by side walls 40, 20, 60 and 80. Second worksurface 130 is attached to workstation 10 via a connecting mechanism 200. Connecting mechanism 200 allows the second worksurface 130, while initially residing in the vertical orientation, to pivotally swing away from the first surface 120 to a horizontal orientation. In this horizontal orientation, second worksurface 130 lies adjacent an outer edge 129 of the first worksurface 120 and substantially horizontal to worksurface 120.

Figure 14:
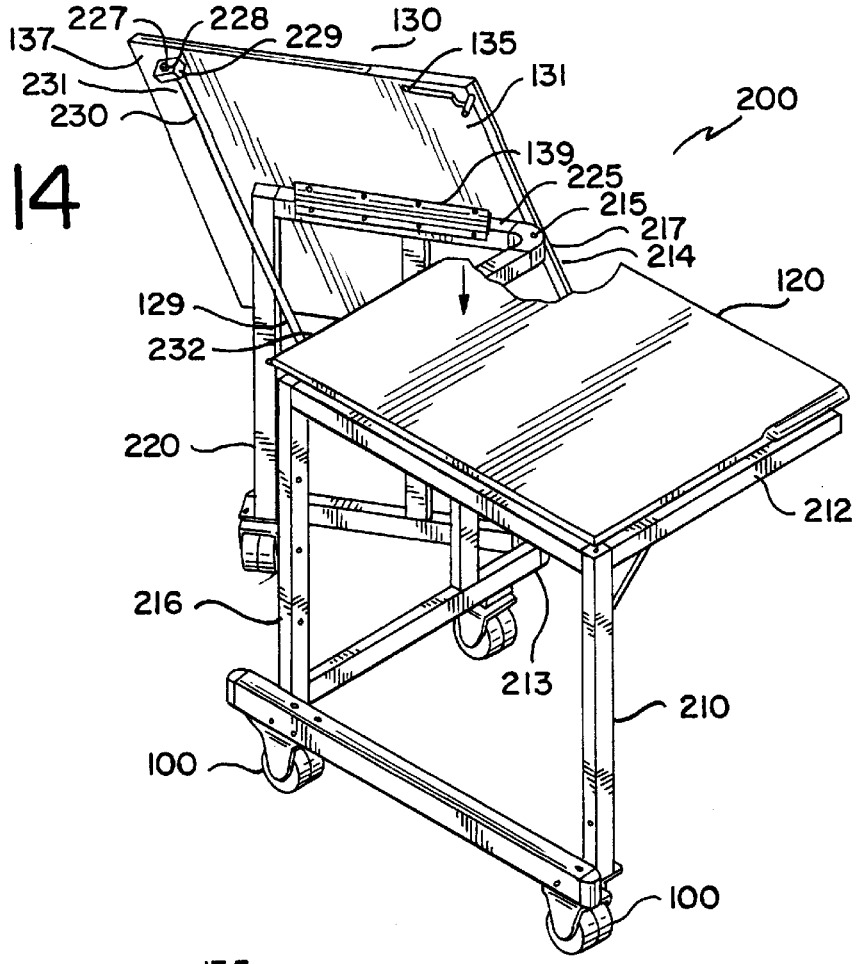
FIG. 14 is another perspective view of the connecting mechanism shown in FIG. 13.
Figure 13:
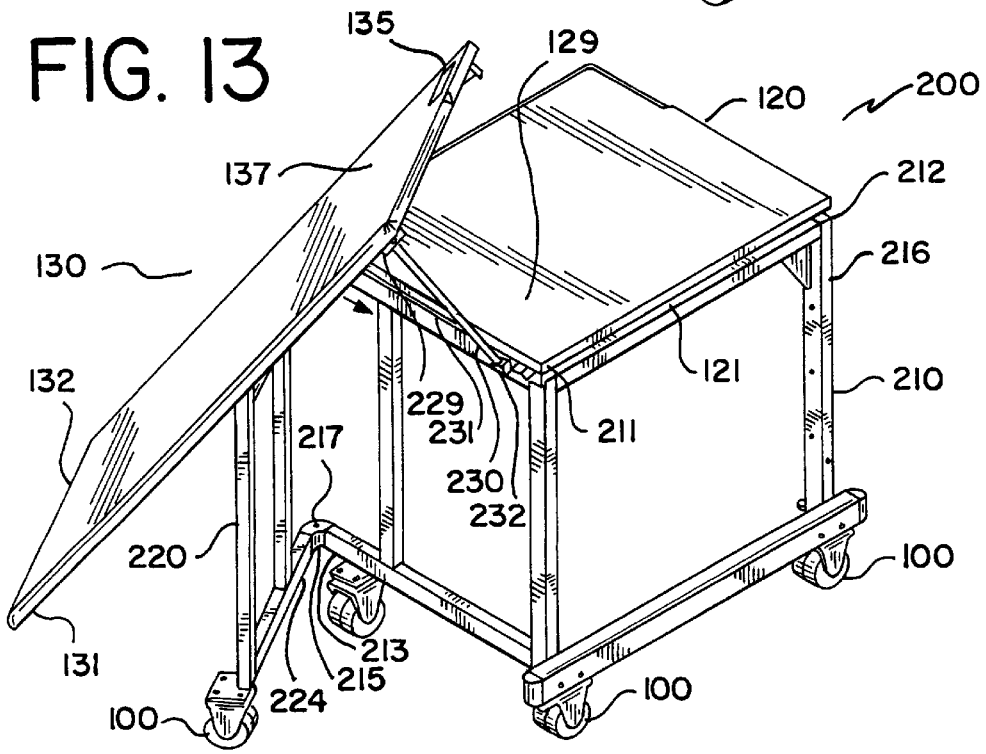
FIG. 13 is a perspective view of a connecting mechanism connecting the first worksurface and the second worksurface shown in FIG. 1.

FIG. 13 is a perspective view of connecting mechanism 200 with the second worksurface 130 residing in a partially unfolded state. FIG. 14 is another perspective view of the connecting mechanism 200 shown in FIG. 13. In both FIGS. 13 and 14, a bottom portion 132 of the second worksurface 130 is being pulled upward and away from worksurface 120. Connecting mechanism 200 comprises a worksurface frame 210 and a support 220.

Referring to FIGS. 13 and 14, worksurface frame 210 is generally a rectangular frame having a top portion 212 and a first side 216. Top portion 212 is attached to an underside 121 of the worksurface 120 and the first side 216 is attached to a first side wall of the collapsible workstation.

Worksurface frame 210 has a first attaching end 213 and second attaching end 214. Preferably, a hinge knuckle 215 having a shoulder bolt 217 is inserted into the first and second attaching ends 213, 214. Together, the shoulder bolts 217 of the first and second attaching ends 213, 214 define a vertical axis about which rotation of the support 220 takes place. The support 220 can therefore pivot between a retracted position and an extended position.

As shown in FIG. 14, support 220 is secured to the underside 131 of second worksurface 130. Preferably, support 220 is affixed to the underside 131 via a horizontal hinge 139. Support 220 comprises a first and a second attaching member 224, 225. First member 224 is rotatably attached to hinge knuckle 215 of first attaching end 213. Similarly, second attaching member 225 is rotatably attached to hinge knuckle 215 of second attaching end 214. Consequently, as the second worksurface 130 changes orientation, support 220 rotates about the vertical axis defined by the shoulder bolts 217 of attaching ends 213, 214. As it rotates, support 220 moves from the retracted position shown in FIG. 5 to the extended position shown in FIG. 1.

Support 220 is also affixed to worksurface frame 210 by way of a connecting device 230. A pivoting block 229 having a hole 228 in a face 227 is attached to the underside 131 of the second worksurface at a second worksurface corner 137. The connecting device 230 is preferably rotatably attached to the second worksurface 130 by placing a first end 231 of the connecting device 230 through the hole 228 of the pivoting block 229. Preferably, a retaining ring is pushed onto the end 231 of the connecting device 230.

A second end 232 of connecting device 230 is attached to a corner 211 of worksurface frame 210. Preferably, the worksurface frame 210 has a clevis and the second end 232 is attached to this clevis by way of a cotter pin. As shown in FIG. 13, as the vertically oriented second worksurface 130 is pulled away from the worksurface 120, connecting device 230 assists in guiding the pivoting support 220 through its rotational motion.

Connecting mechanism 200 further comprises casters 100 which allow the collapsible workstation 10 to be wheeled from one location to the next. Preferably, the casters 100 are affixed to the underside of the worksurface frame 210 and pivoting support 220 and allow the workstation 10 to be wheeled about whether the second worksurface 130 is in the horizontal or the vertical orientation. Casters 100 also facilitate rotation of support 220.

In the horizontal orientation, second worksurface 130 resides adjacent an outer edge 129 of the first worksurface, thereby providing an horizontal extension the worksurface 120. Preferably, worksurface 120 resides at a height above existing floor 1 such that a user of workstation 10 sits comfortably adjacent worksurface 120 and second worksurface 130.

Returning to FIGS. 1, 8 and 9, second worksurface 130 preferably comprises a latching device 135. Latching device 135 enables second worksurface 130 to be releasably secured to worksurface 120 while second worksurface 130 remains in the horizontal orientation. Device 135 prohibits inadvertent movement of second worksurface 130.

As also shown in FIGS. 1, 8 and 9, top cover 41 of side wall 40 and top cover 61 of side wall 60 are swung upwardly. In this position, top covers 41, 61 provide an increased sense of privacy to the workstation user and additional surface area. This additional surface area can be used to mount or support accessories such as marker boards, white boards, tack boards or the like.

A light fixture 55 is attached to the inner surfaces 50, 70. Although light fixtures 55 can be battery powered, workstation 10 is preferably wired for receiving electrical power from a remote power source. This electrical power can then be distributed to light fixtures 55 and other power outlets within the workstation.

Alternatively, a workstation is prewired and supplied with an uninterruptible power supply. The uninterruptible power supply supplies a back up power system in the event the remote power source fails or is not available. The uninterruptible power supply also provides protection against voltage transients and suppression of electrical line interference such as harmonics.

Preferably, a prewired workstation distributes electrical power to various electrical outlets within the workstation. The distributed power is available to energize electrical devices and utilities installed either on shelf 160, in storage cabinet 150, along the inner wall surfaces or elsewhere within workstation 10. Possible devices include computers, printers, phones, speakers, video screens (preferably flat screens mounted to one of the side walls), modems, facsimile machines, servers, telephone networks, bridges, switches and the like.

With reference to second side wall 60, latching post 170 is disposed on the inner surface 67 adjacent the vertical edge 64. Latching post 170 cooperates with latching hole 172 disposed along an outer edge 133 of second worksurface 130 while workstation 10 resides in the collapsed position. In other words, as second worksurface 130 resides in the vertical orientation as shown in FIGS. 1, 8 and 9, latching hole 172 is axially oriented laterally outward away from second worksurface 130 and mates with latching pin 170 of side wall 60. The latching hole 170 and latching pin 172 configuration reduces shifting of the collapsed workstation during transportation and thereby increases workstation rigidity.

As shown in FIGS. 1, 8 and 9, fourth side wall 80 is in an unfolded position. In this position, fourth side wall 80 acts as a screen providing the workstation user with a sense of increased privacy. Side wall 80 also acts as a barrier reducing from ambient noise in the workstation. This may be particularly useful where workstation 10 resides in an environment having a loud ambient noise such as on a manufacturing floor, in a customer service center or even a residence. Side wall 80 also reduces workstation noise from being transmitted into its surrounding work environment.

Side wall 80 includes an inner surface 81 and an outer surface 82 preferably made from a material which is lightweight and durable. An example of an inner surface 81 material that may be used in a preferred embodiment includes a high pressure laminate markerboard from H & R Wood Specialty, Inc. An example of an outer surface 82 material that may be used in a preferred embodiment includes a vinyl film from H & R Wood Specialty, Inc. In an alternative embodiment, a marker board, white board or tack board is affixed over a top edge 83 of fourth side wall 80. In this alternative embodiment, these items are viewable from the exterior of the workstation 10.

Figure 10:
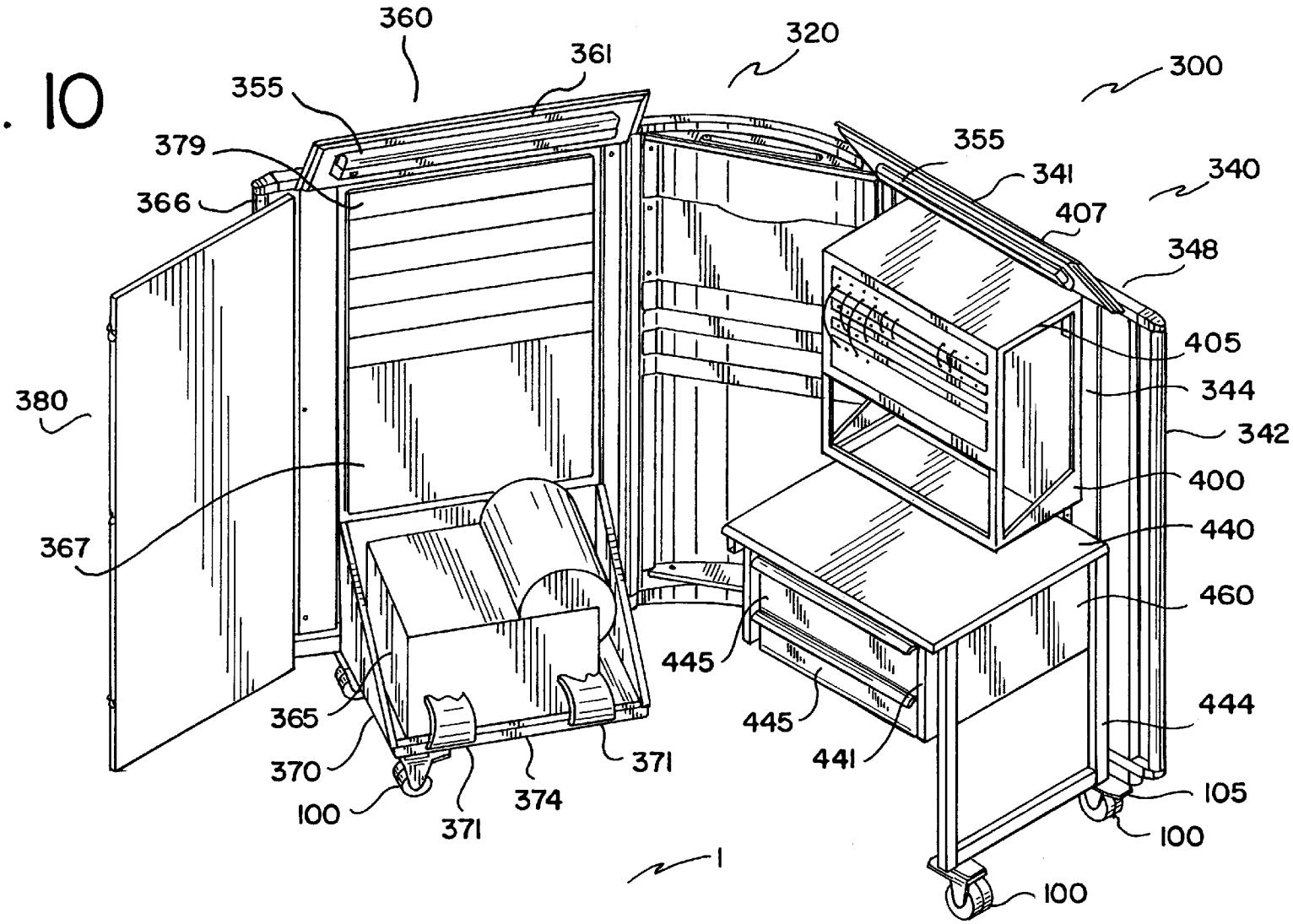
FIG. 10 is a perspective view of a service unit of the present invention.

FIG. 10 shows another embodiment of the present invention. In this other embodiment, a work environment can be provided with a service unit servicing a number of workstations. The service unit provides a type of utility, hardware or shared device to a number of networked workstations. In particular, FIG. 10 shows a service unit 300 comprising a first side wall 340, a third side wall 320, a second side wall 360 and a fourth side wall 380. Preferably, side walls 340, 320, 360 and 380 are attached to one another in a generally similar manner as side walls 40, 20, 60 and 80 previously described with reference to FIGS. 1–9.

Service unit 300 is transportable. Casters 100 are secured at various underside locations of service unit 300 to facilitate the maneuverability of the service unit in either its collapsed state or any expanded state. Casters 100 are provided with a locking device 105. Preferably, at least one locking device 105 is lockable while service unit 300 is in the collapsed or expanded position.

Preferably, service unit 300 is collapsible into the generally rectangular box shown in FIGS. 2–4. In the collapsed state, service unit 300 has the same general dimensions as the collapsed workstation 10 shown in FIGS. 2–4.

Service unit 300 has a first side wall 340 which preferably has a hand rail 342, an inner surface 344 and an outer surface 348. A handrail 366 is also provided on third side wall 360. Preferably, hand rails 342, 366 facilitate maneuvering of service unit 300. The mechanical features and advantages of the handrails 342, 366 are similar to those previously discussed with respect to handrails 46, 66 shown in FIGS. 2–4.

Preferably, the first wall inner surface 344 comprises an equipment rack 400, a worksurface 440 residing underneath equipment rack 400 and a storage cabinet 460 mounted beneath worksurface 440.

Equipment rack 400 is screwed or bolted along inner surface 344. Preferably, equipment rack 400 has a length generally equivalent to a length of the first side wall 340 and a width generally equivalent to a width of the second side wall 320. The equipment rack has a number of slots or trays in which various electrical components can be mounted. Types of electrical components which can be mounted within the rack include such items as servers, phone systems, communication devices, backup computer storage hardware and the like. The equipment rack allows the user to customize the service unit for a particular need. The equipment rack configuration facilitates the mounting, interconnecting, troubleshooting and removal of the installed components.

Equipment rack 400 preferably contains hardware 405 for networking a plurality of workstations. Hardware 405 could have a communication device 407 for enabling the interchange of data between service unit 300, a plurality of workstations, other service units and remote data sources. Via hardware 405, networked workstations can communicate with other networked workstations. Types of hardware that may be used to network other workstations include computers, file servers, and other related devices.

Communication device 407 enables the networked workstations to access a shared device or utility installed within the service unit. Instructions can be transmitted from the networked workstations to the service unit for the utility to perform certain tasks. These tasks can then be performed by the shared utility, which can then supply a task availability or a task completion notice to the networked workstations.

A worksurface 440 is disposed along the inner surface 344 of first side wall 340 underneath equipment rack 400. In the preferred embodiment, worksurface 440 is rigidly affixed to the inner surface 344 and supported by a bracket 444. Bracket 444 extends toward the floor 1 and comprises casters 100 which facilitate service unit 300 maneuverability.

Worksurface 440 resides in a horizontal plane at a height above the existing floor 1 such that a user can sit comfortably adjacent the worksurface 440. Storage drawers 445 are preferably disposed on the underside 441 of the worksurface and contain accessories for maintaining service unit 300 such as patch cables, spare casters, paper tablets and other office supplies.

The first side wall 340 and the second side wall 360 of service unit 300 have top covers 341, 361 respectively. Top covers 341, 361 have generally the same mechanical features and provide similar advantages as top covers 41, 61 of the collapsible workstation 10 as previously described with reference to FIGS. 1, 7 and 8. Alternatively, a light fixture 355 is disposed on the underside of top covers 341, 361.

Preferably, the service unit 300 has wiring which distributes electrical power to various electrical outlets within the service unit. The distributed power is available to energize electrical components installed either in equipment rack 400, in an equipment platform 370 or elsewhere within service unit 300. Possible devices include computers, printers, modems, light units, facsimile machines, servers, video monitors, telephones, telephone networks, bridges, switches and the like.

Third side wall 320 is attached to first side wall 340. Preferably, third side wall of service unit 300 has generally the same mechanical features as the third side wall 20 of collapsible workstation 10 previously described.

Second side wall 360 is attached to third side wall 320. Preferably, the general mechanical characteristics of the third side wall 320 are similar to those as detailed with respect to the third side wall 20 of the collapsible workstation 10 previously described.

Second side wall 380 preferably comprises an inner surface 367 and an equipment platform 370. Various workstation accessories can be attached, mounted on or installed on surface area 367 including a telephone, flat screens, speakers, a tack board, white board or marker boards. Alternatively, a holding device for storing paper pads, marker boards or other accessories ordinarily used in the workstation is provided.

Preferably, the surface 367 includes a retaining device 379, as shown in FIG. 10. The retaining device 379 provides a means for mounting work-in-process items such as trays, tape dispensers, small tiles, and the like. For a complete description and disclosure of that device, one is directed to U.S. Pat. No. B1 4,876,835, issued to Kelly et al. on Jun. 30, 1992, the entire disclosure of which is hereby incorporated by reference.

Equipment platform 370 is rigidly affixed to a bottom portion of the second side wall 360. Preferably, platform 370 is bolted or screwed to the second side wall 360 and provided with a number of casters 100 on the platform underside 374.

Platform 370 preferably has a length generally equivalent to the length of the second side wall 360 and a width generally equivalent to a width of the third side wall 320. Platform 370 is wide enough so that it can accommodate a device such as an electrical work tool or office equipment. Devices installed on platform 370 could include a network printer, server, facsimile machine, modem, copying machine, or other type of device generally found in a workstation or workplace environment. Platform 370 is preferably configured as to allow the service unit to be customized according to a customer's standard configuration or for a particular use.

Alternatively, the service unit houses other types of shared utilities which could be used by workstation users. These other types of shared utilities need not necessarily perform business related tasks. For example, such other utilities could include a refrigerator, microwave oven, toaster, coffer machine, soft drink dispenser, or any other like component which one finds in a shared office environment. As previously discussed, shared device 365 can be accessed by a plurality of networked workstation users via hardware 405 installed in equipment rack 400.

Equipment platform 370 preferably comprises holding straps 371 for releasably securing device 365 disposed on platform 370. Holding straps 371 allow for the quick removal of the equipment if device maintenance or repair is required.

Figure 11:
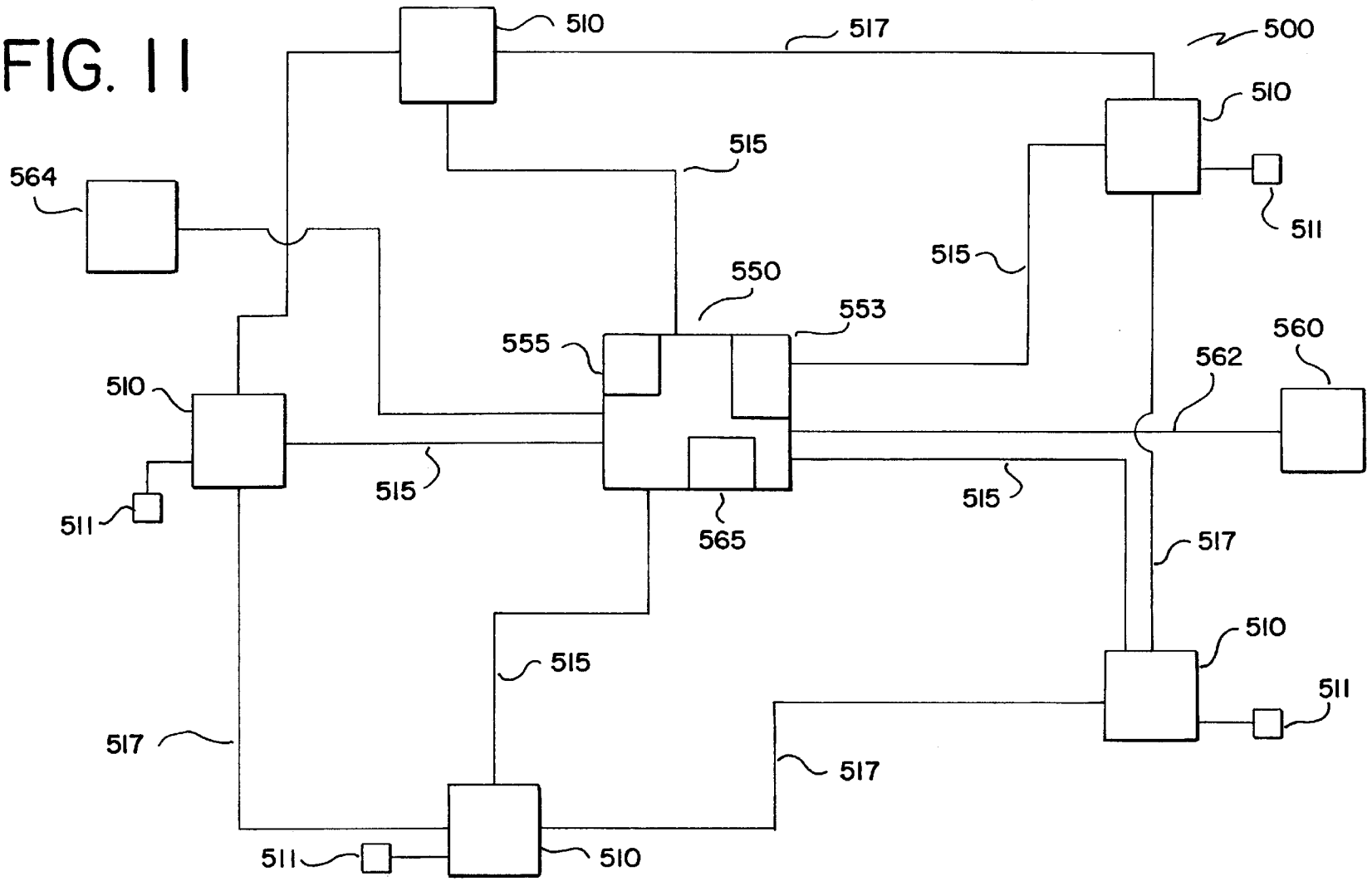
FIG. 11 is a schematic view of a work environment incorporating the alternative embodiment shown in FIG. 10.

As previously mentioned, shared device 365 can be networked to a plurality of workstations. FIG. 11 shows a preferred embodiment of a networked work environment 500. FIG. 11 shows a plurality of workstations 510 networked to a service unit 550. Service unit 550 has preferably the same mechanical features and characteristics as service unit 300 previously described in reference to FIG. 10. Preferably, workstations 510 have generally similar mechanical features and characteristics as workstation 10 described in reference to FIGS. 1–9. The workstations 510 and service unit 550 shown in FIG. 11 may either be in the collapsed or extended position.

In this embodiment, service unit 550 has a power distribution device 553 for receiving power from an external power source 560. Power distribution device 553 is capable of distributing power to service unit 550 and the networked workstations 510. Power distribution device 553 may also have a surge suppressor. Alternatively, the workstations 510 receive power from an external power source 511.

Preferably, service unit 550 comprises a shared device 555. Shared device 555, hardware and other electrical equipment of service unit 550 may be powered from the power receiving device 553 or alternatively a back up system such as an uninterruptible power supply 565. Uninterruptible power supply 565 is capable of supplying power to the shared device 555 or the service unit in the event power from the power source 560 is interrupted.

The workstations are preferably configured in a star configuration whereby they are connected only to a service unit. Workstations could also be connected in a hub and wheel configuration so that each workstation communicates directly with both a service unit and other workstations.

As shown in FIG. 11, workstations 510 are connected to service unit 550 via cabling 515. Power and/or data is transmitted between the workstations and the service unit via cabling 515. Preferably, workstations communicate with a service unit via a wireless device. An example of a wireless device that may be used in an alternative embodiment includes the Infrared LAN network from ACTi SYS, Inc. Another example of a wireless device that may be used in an alternative embodiment includes a radio frequency wireless LAN network from Amp, Inc.

In the embodiment shown in FIG. 11, service unit 550 is connected to an external data source 564 which may be a central computer or remote work environment. Preferably, the remote work environment has a remote service unit supporting a plurality of workstations. In this alternative connection scheme, a service unit could receive power, information or both from the remote service unit.

Figure 12:
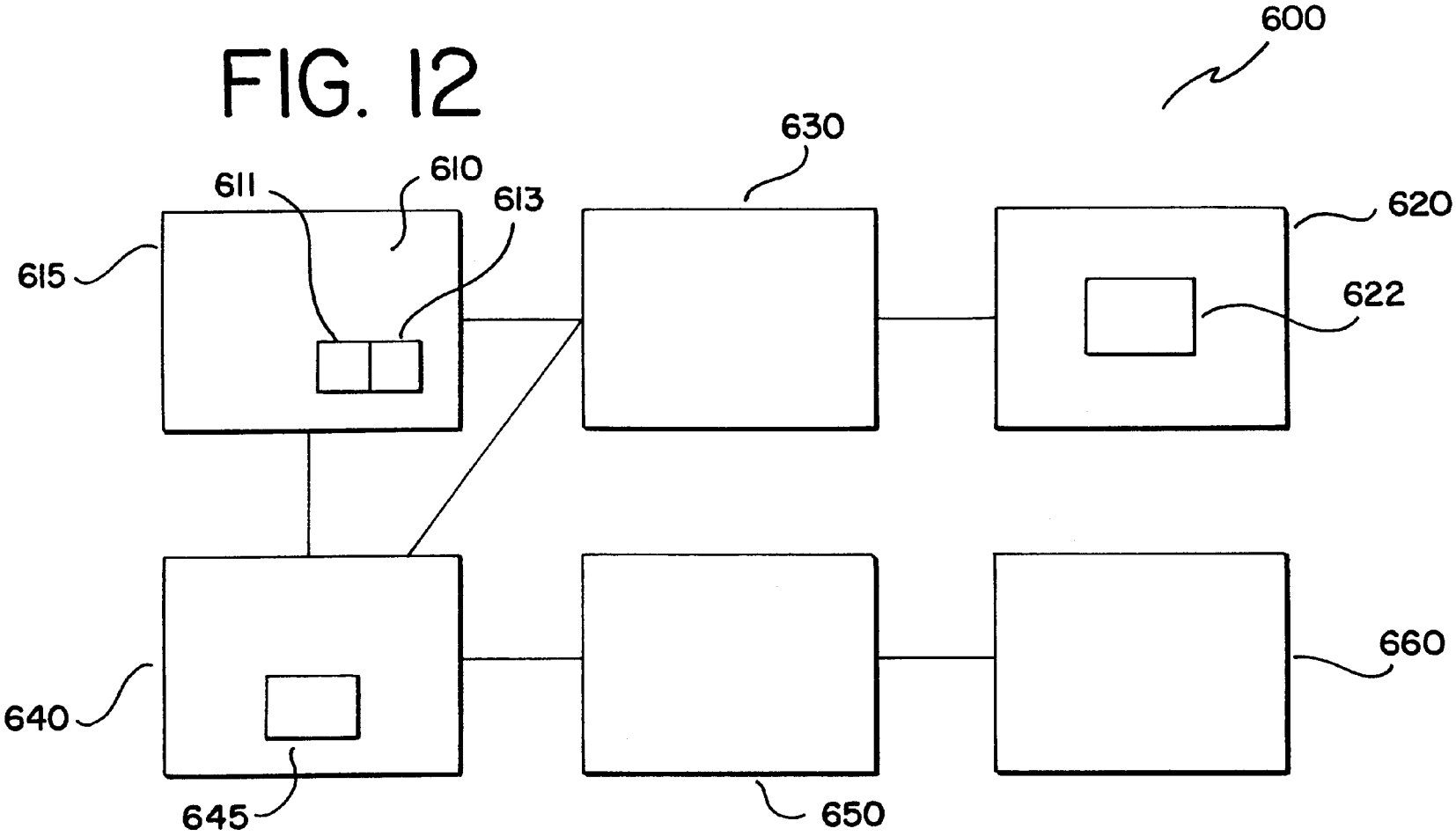
FIG. 12 is a schematic representation of the preferred system for providing work environments at multiple and varying remote locations.

FIG. 12 illustrates a preferred embodiment of another aspect of the present invention. FIG. 12 shows a system 600 for providing work environments at multiple and varying remote locations. The system 600 comprises an inventory 610 of workstations 611 and service units 613 at a first location 615, a means for receiving an order 630, and a transporting means 640.

An inventory 610 of workstations 611 and service units 613 is maintained at the first location 615. Preferably, workstations 611 have generally similar characteristics and features to workstation 10 as previously described with reference to FIGS. 1–9. More preferably, workstations 611 are adapted to be arranged with a number of the other of the workstations to define a work environment such as the environment shown in FIG. 11. For example, some of the inventoried workstations 611 can include wiring for distributing and/or data within the workstation itself or within a work environment. Other units may be arranged with computer components and related equipment such as personal computers, printers, modems, flatscreens, and the like.

The inventoried service units 613 preferably have generally the same characteristics and features as service unit 300 previously described in reference to FIG. 10.

The first location 615 may be located where the units are manufactured. Alternatively, first location 615 is a different location such as a warehouse, storage facility or distribution point. This different location may be located near a remote location 650. Alternatively, a plurality of warehouse, storage or distribution facilities are set up and strategically arranged throughout a state, region or country to ease the logistics of transporting and delivering the inventory of collapsible and transportable units among multiple remote locations.

A customer 620 generates an order 622 for a work environment. The ordered work environment may comprise both work station units and service units. Alternatively, the order 622 may request a work environment consisting of only workstations 611. The order 622 may specify a remote location 650 for the workstations, the number of workstations and the type of workstations.

The order 622 is received by an order receiving means 630. The order is communicated to the receiving means via a medium normally used in a business environment such as via over the phone, via facsimile, by way of the mail, electric-mail, over the Internet or an intranet. The receiving means 630 is preferably a processing location such as a customer service center, sales office or distributor. This location processes the order. The receiving means 630 may be located at the same location where the workstations and service units are inventoried. Alternatively, a number of receiving means are set up to support a state, region or country. After the order 622 is processed, it is then sent to either the first location 615 or to a transporting means 640. The workstations and service units are then prepared for delivery to the remote location 650.

The inventory of workstations 611 and service units 613 are prepared according to order 622. Preferably, the workstations 611 and service units 613 comprise removable components such as shelves, worksurfaces, storage cabinets, and communication interfaces. Other electrical related devices including flat screens, telephones, telephone systems, copy machines, modems, speakers, personal computers, video monitors and the like could also be provided. In this manner, the inventoried units can be stored in a non-modified, standard configuration. Once the order 622 is received, the non-modified units are then customized with the appropriate removable modules according to the customer's specifications or a particular need. This modification scheme provides a quick method to customize a workstation to a customer's requirements.

A transporting means 640 transports the workstations and service units to the requested remote location 650. The transporting means receives delivery instructions from either the first location 615 or from the receiving means 630. The workstations and service units could be transported via common carrier by way of truck, rail, airplane or other similar type of transporting means.

Preferably, the transporting means 640 is a delivery network 645. Delivery network 645 delivers the workstations 611 and service units 613 from the first location 615 to the remote location 650 specified in the order 622.

Preferably, the delivery network 645 is the manufacturer of the workstations. Alternatively, the delivery network 645 is a separate delivery organization. An example of a separate delivery organization includes Federal Express, DHL, Airborne or other like organizations.

Remote location 650 may be the location 620 from where the order 622 was generated. Alternatively, the remote location 650 is a different location. For example, when a large corporate concern or a multi-divisional corporate entity places an order, it may be requested that the workstations and service units be delivered to a related subsidiary, division or remote branch office.

The workstations and service units reside temporarily at the remote location 650. After their use, the workstations 610 and service units 613 are returned to first location 615. Alternatively, they are returned to another location 660 where the units may be refurbished, maintained repaired.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that is the appended claims including all equivalents thereof, which are intended to define the scope of the invention.

We claim:

1. A collapsible workstation comprising:

a first side wall;

a second side wall;

a third side wall with a first vertical edge hingedly attached to the first side wall and with a second vertical edge hingedly attached to the second side wall;

a first worksurface having a support structure attached to first side wall; and a second worksurface having a support structure with a caster pivotally attached to the first work surface support structure, the worksurface moveable between a generally vertical orientation substantially perpendicular to the first side wall, thereby providing a privacy screen for a workstation user and a generally horizontal orientation adjacent and substantially parallel to the first worksurface and substantially perpendicular to the first side wall, thereby extending usable worksurface for the workstation user.

2. A collapsible workstation comprising:

a first side wall;

a second side wall;

a third side wall with a first vertical edge hingedly attached to the first side wall and with a second vertical edge hingedly attached to the second side wall;

a first worksurface having a support structure attached to first side wall; and a second worksurface having a support structure pivotally attached to the first work surface support structure and pivotable between a retracted and an extended position, the worksurface moveable between a generally vertical orientation substantially perpendicular to the first side wall when in the retracted position, thereby providing a privacy screen for a workstation user and a generally horizontal orientation adjacent and substantially parallel to the first worksurface and substantially perpendicular to the first side wall when in the extended position, thereby extending usable worksurface for the workstation user.

* * * * *